United States Patent [19]

Hodgkins et al.

[11] Patent Number: 4,876,990

[45] Date of Patent: Oct. 31, 1989

[54] SPRAY NOZZLE ASSEMBLY FOR PISTON COOLING

[75] Inventors: David H. Hodgkins, Granby; Leon P. Janik, Suffield, both of Conn.

[73] Assignee: Stanadyne Automotive Corp., Windsor, Conn.

[21] Appl. No.: 251,906

[22] Filed: Sep. 30, 1988

Related U.S. Application Data

[63] Continuation-in-part of Ser. No. 203,439, Jun. 7, 1988, abandoned.

[51] Int. Cl.[4] ..... F01P 3/08

[52] U.S. Cl. ..... 723/41.35; 239/555; 184/6.26; 29/513

[58] Field of Search ..... 123/41.35; 239/555; 29/157 R, 157 C, 157.1, 513; 184/6.26

[56] References Cited

U.S. PATENT DOCUMENTS

| | | | |
|---|---|---|---|
| 2,800,119 | 7/1957 | Schmidl | 123/41.35 |
| 3,615,054 | 10/1971 | Botz | 239/555 |
| 3,937,109 | 2/1976 | Korner et al. | 29/513 |
| 4,602,413 | 7/1986 | Krauss et al. | 29/157.1 R |

*Primary Examiner*—Noah P. Kamen

*Attorney, Agent, or Firm*—Chilton, Alix & Van Kirk

[57] ABSTRACT

A tubular nozzle tip is connected to a holder member that is made entirely of sheet metal, the combination being secured together into a nozzle assembly by the bending and tightening of flanges associated with a housing or cover plate portion of the holder member. Preferably, the nozzle tip has a D shaped cross section at the end to be mounted in the holder member and the holder member includes a cover plate having a channel of similar cross section adapted to receive the nozzle tip and form a passageway for delivering oil to the nozzle tip discharge orifice.

15 Claims, 11 Drawing Sheets

SPRAY NOZZLE ASSEMBLY FOR PISTON COOLING

CROSS REFERENCE TO RELATED APPLICATION

This application is a continuation in part of application Ser. No. 203,439 filed on June 7, 1988, now abandoned.

BACKGROUND OF THE INVENTION

This invention relates generally to devices and systems for cooling the pistons in internal combustion engines. More particularly, this invention relates generally to crankcase oil spray nozzles employed for cooling pistons.

Internal combustion engines and in particular diesel engines employ oil and lubrication systems to cool or remove heat from the area of the piston and cylinder. In one conventional cooling system, tubular nozzles extend at the interior of the engine crankcase and are oriented to direct a spray of oil at the underside of the piston crown. The tubular nozzles communicate with the oil supply gallery. A check valve in the nozzle selectively prevents the spray of oil from the nozzle until the oil pressure exceeds a pre-established threshold. An oil spray nozzle is located in each of the engine cylinders.

SUMMARY OF THE INVENTION

Briefly stated, the invention in a preferred form is a crankcase oil spray nozzle for cooling a piston in an internal combustion engine. The oil spray nozzle has an efficient low cost sandwich-type construction which permits installation in the engine crankcase in an efficient manner. The oil spray nozzle in some embodiments incorporates an internal filter system to insure reliable operation.

In one embodiment, a housing member forms a transversely protruding inlet well which defines an inlet opening intermediate a nozzle end and an opposing second end of the housing member. The housing member also comprises a pair of laterally spaced sidewalls. A cover plate is received between the sidewalls and secured to the housing member by folded extensions of the sidewalls. The cover plate cooperates with the housing member to define a nozzle passageway which extends from the well to a nozzle orifice at the nozzle end. A check valve comprising a valve member and a spring is received in the well and captured between the housing member and the cover plate. The valve member is biased by the spring to prevent the passage of fluid through the passageway when the pressure of the fluid is below a pre-established threshold. The valve member is displaceable to permit the passage of fluid for injection through the nozzle orifice.

An intermediate plate may be disposed between the housing member and the cover plate in a sandwich-like fashion. The intermediate plate, the housing member, and the cover plate define the nozzle passageway. The spring may be employed as a filter to the passage fluid between the inlet opening and the nozzle orifice. The housing member and the cover plate may also have an array of projections which cooperate to define an internal edge filter in the nozzle passageway.

In one embodiment, a leaf spring is anchored at one end between the housing member and the cover plate to interrupt the passage of fluid through the nozzle when the fluid is below a pre-established threshold. The cover plate has an arcuate cross section and the housing member has a planar portion which cooperate to define the fluid passageway of the nozzle. The cover plate has a terminus which is rounded to define a deflector adjacent to the nozzle orifice.

In another, apparatus and method embodiment, a tubular nozzle tip is connected to a holder member that is made entirely of sheet metal, the combination being secured together into a nozzle assembly by the bending and tightening of flanges associated with a housing or cover plate portion of the holder member. Preferably, the nozzle tip has a D shaped cross section at the end to be mounted in the holder member and the holder member includes a cover plate having a channel of similar cross section adapted to receive the nozzle tip and form a passageway for delivering oil to the nozzle tip discharge orifice.

An object of the invention is to provide a new and improved oil spray nozzle for cooling the piston of an internal combustion engine by emitting a spray of lubricant and directing the spray at the underside crown of the piston.

Another object of the invention is to provide a new and improved crankcase oil spray nozzle of efficient and low cost construction.

Other objects and advantages will become apparent from the drawings and the specification.

DETAILED DESCRIPTION OF THE INVENTION

Figure 1:
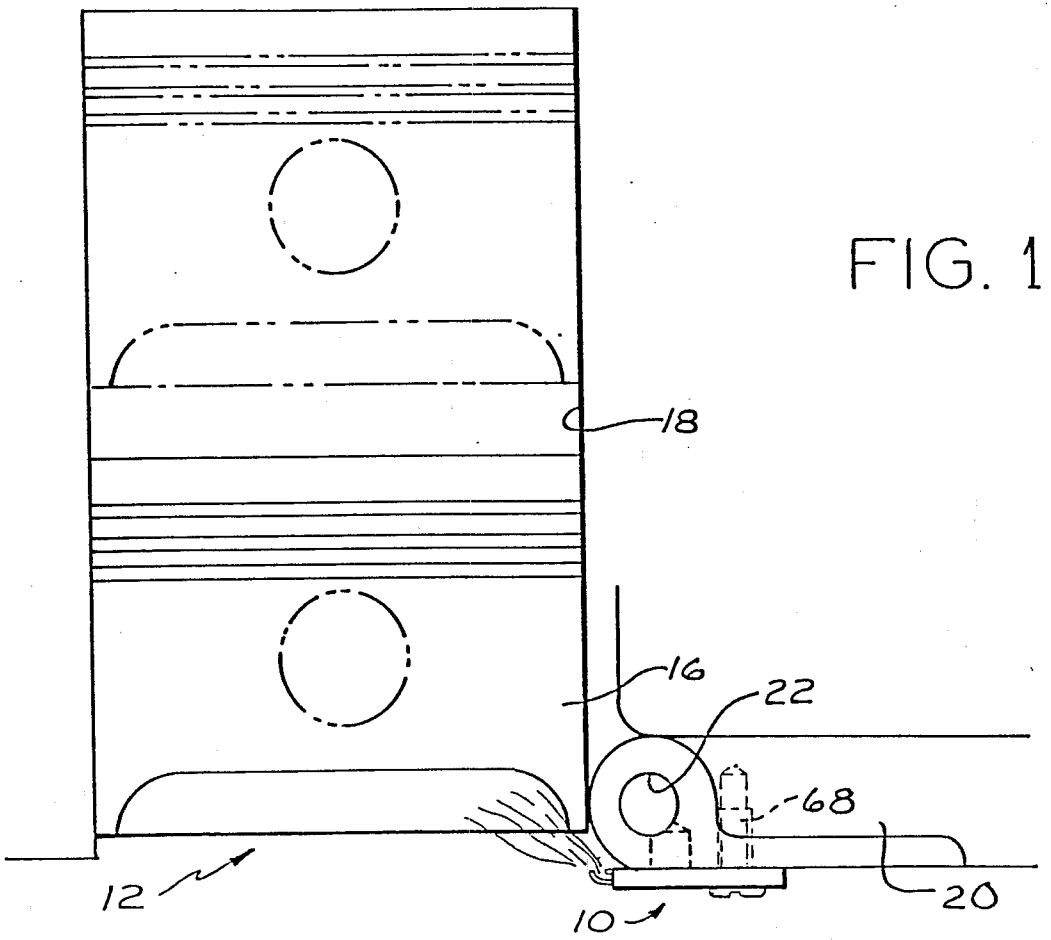
FIG. 1 is an interior fragmentary view, partly in schematic and partly in section, of an engine crankcase illustrating a cylinder and piston and an associated cooling nozzle in accordance with the present invention.

With reference to the drawings wherein like numerals represent like parts throughout the several figures, an oil spray nozzle in accordance with the present invention is generally designated by the numeral 10 in FIG. 1. Oil spray nozzle 10 is employed in an internal combustion engine 12 and oriented for spraying the underside crown of a piston 16 of a given cylinder 18. The oil spray nozzle 10 is mounted interiorly of the engine crankcase 20 and fluidly communicates with the oil supply passage or gallery 22 of the crankcase for supplying oil under pressure. When the oil pressure exceeds a pre-established threshold pressure, pressurized oil traverses through the nozzle 10 for injection or spraying at the underside crown of the piston. The nozzle thus functions to cool the piston crown during engine operation. Connecting rods and other engine components have been omitted from FIG. 1 to better illustrate the invention. The location and the low-profile dimensions of the nozzle are selected to provide clearance with the operational path of the connecting rod and the counter weight. It should be appreciated that a piston cooling nozzle 10 is preferably provided for each corresponding piston of the engine.

Figure 2:
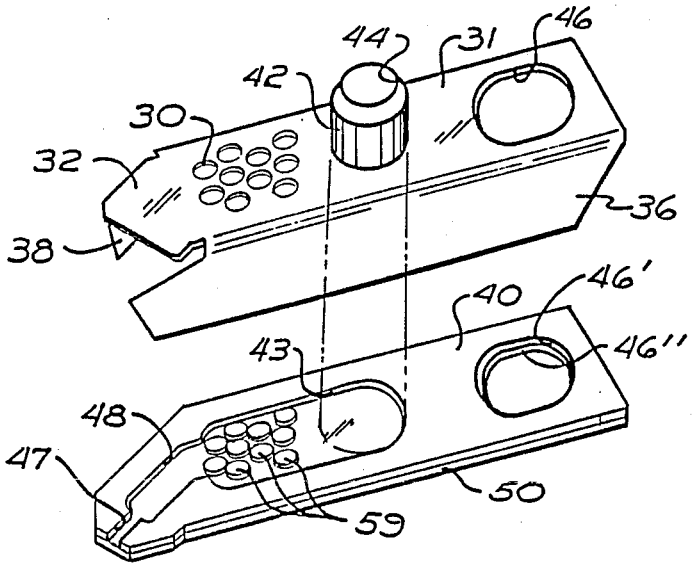
FIG. 2 is an enlarged exploded view of the piston cooling nozzle of FIG. 1 illustrated in a pre-assembled stage.
Figure 3:
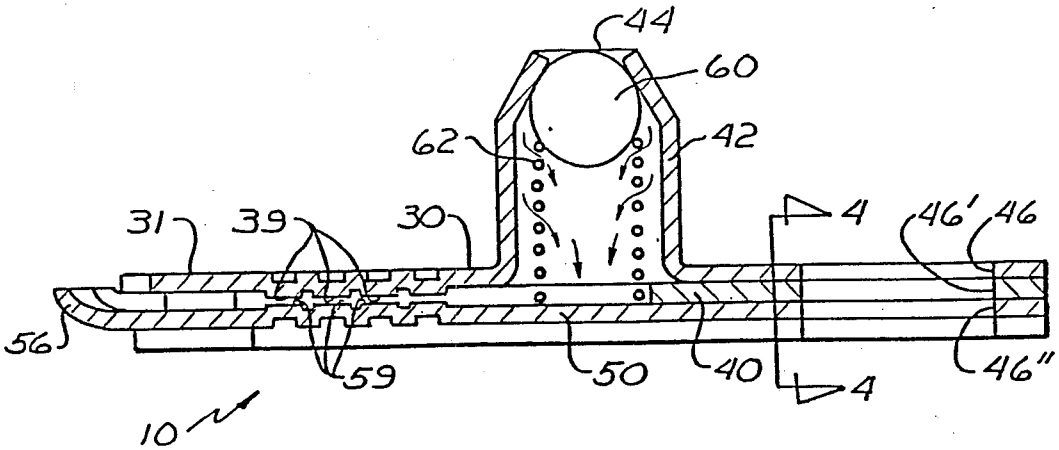
FIG. 3 is an enlarged longitudinal sectional view of the piston cooling nozzle of FIG. 2.
Figure 4:
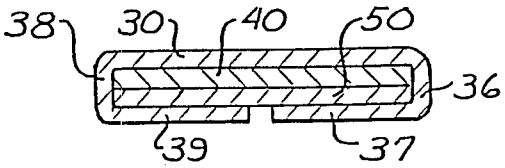
FIG. 4 is a sectional view of the piston cooling nozzle taken along the line 4—4 of FIG. 3.

With additional reference to FIGS. 2–4, the oil spray nozzle 10 in one embodiment has a sandwich-type assembled configuration formed from stamped components. The oil spray nozzle 10 comprises a three-component sandwich-type, main body structure including a housing 30, an intermediate passage plate 40 and a cover plate 50. Each of the three components may be stamped or formed from metallic material.

The housing 30 generally defines the exterior profile of the nozzle and also functions to provide structure for securing the nozzle components in assembled relationship. The housing is initially stamped from a plate in a multi-surface shape having a nose-like end tab 32, and a pair of laterally spaced creased skirts 36 and 38 which form sidewalls and securing flanges as will be hereinafter described in detail. An integrally extending well 42 is centrally formed in the plate so as to protrude from a planar plate 31 portion of the stamped housing. The well 42 has a generally cylindrical shape with a tapered terminus which defines an inlet opening 44 for the nozzle. An aperture 46 is punched or otherwise formed in the base plate 31 equidistantly between skirts 36 and 38 and longitudinally spaced from well 44.

The base plate 31 extending between the skirts 36 and 38 essentially functions as a receiving tray for the generally planar intermediate passage plate 40. Passage plate 40 is generally planar and has a peripheral shape similar to the base plate 31 of the housing. Passage plate 40 is interiorly received by the housing and abuts against the base plate 31 in surface-to-surface relationship. The intermediate passage plate 40 has a cutout portion defining a well opening 43 and a nozzle passageway 48 leading from the opening 43 to a narrow nozzle orifice 47 formed at the forward end of the passage plate 40. The well opening 43 generally aligns with the well 42 formed in the housing. The nozzle passageway 48 extends generally from the well and obliquely angles toward the nozzle orifice 47. The passage 48 is reduced or tapered at the outlet end to form the nozzle orifice 47. The intermediate plate has a nose-like terminus which generally conforms to the shape of the nose end of the housing base plate 31. An aperture 46' substantially similar in size and shape to aperture 46 is also stamped or formed in plate 40. The dimensions of the well opening 43, nozzle orifice 47 and passageway 48 may be precisely defined by the interior edges of the intermediate plate 40.

The cover plate 50 is generally planar and has a peripheral shape substantially similar to that of the intermediate plate 40. The cover plate 50 also has an aperture 46" which is dimensioned to be substantially similar to that of apertures 46 and 46' and generally alignable therewith. The cover plate 50 engages against the intermediate plate 40 which, in turn, engages against the base plate 30 in a generally tri-layered surface-to-surface relationship. The skirts 36 and 38 are bent over so as to engage against the cover plate 50 to form integral retaining flanges 37 and 39, respectively, to secure the three plates in a sandwich type-configuration. The nose end of the cover plate 50 extends beyond the corresponding nose portion of the housing. The terminus of the cover plate nose portion and a corresponding small portion of the passage plate nose is curved and/or angled so as to form a nozzle opening deflector 56 for deflecting and directing the spray toward the piston crown. The shape of the deflector 56 is selected to provide the desired spray pattern for a given crankcase/piston configuration. The cover plate, intermediate plate and housing cooperate to define an interior nozzle passage which is substantially fluid tight so that a fluid passageway extends from the inlet opening 44 through the nozzle orifice 47. The preferred application of the nozzle as a piston cooler does not require that the nozzle passageway and fluid flow path through the nozzle be hermetically sealed.

A check valve assembly comprising a ball valve 60 and a spring 62 are received in the well 42 and captured between the housing 30 and the cover plate 50. The ball valve 60 is biased to seat against an interior seat proximate to the well terminus to cover the inlet opening 44. After inserting the valve 60 and spring 62 into the well 42, the sidewalls 36 and 38 are bent around both the intermediate plate and the cover plate to enclose and retain the check valve assembly comprising the ball valve 60 and the biasing spring 62. The check valve assembly functions to close the inlet opening to the passage of pressurized oil until the oil exceeds a pre-established pressure threshold, at which time the oil communicates through the inlet 44 and the formed nozzle passage 48 for spray injection through the nozzle orifice 47. The pressure threshold is defined by the force of spring 62.

The substantially identical circular apertures 46, 46', and 46" which are punched or otherwise formed in the base plate, intermediate plate and cover plate align to define a fastener opening transversely extending through the flattened sandwich-type nozzle body. The nozzle 10 is thus easily mounted at the crankcase interior by means of a conventional fastener 68. The nose end portions of the intermediate passage plate and the cover plate are slightly bent to provide the correct orientation of the nozzle relative to the piston crown.

Figure 5:
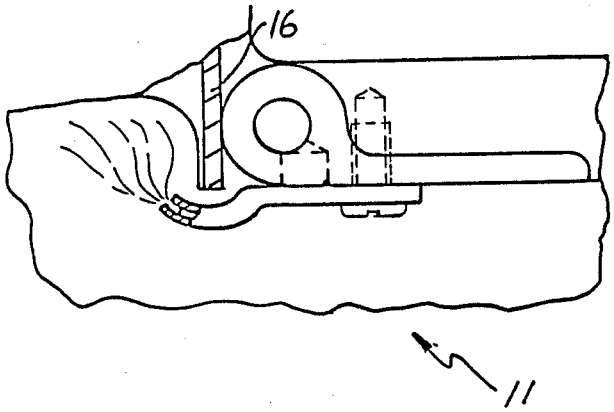
FIG. 5 is a fragmentary sectional view, partly broken away and partly in phantom, illustrating a portion of an engine and a second embodiment of an associated cooling nozzle in accordance with the present invention.
Figure 6:
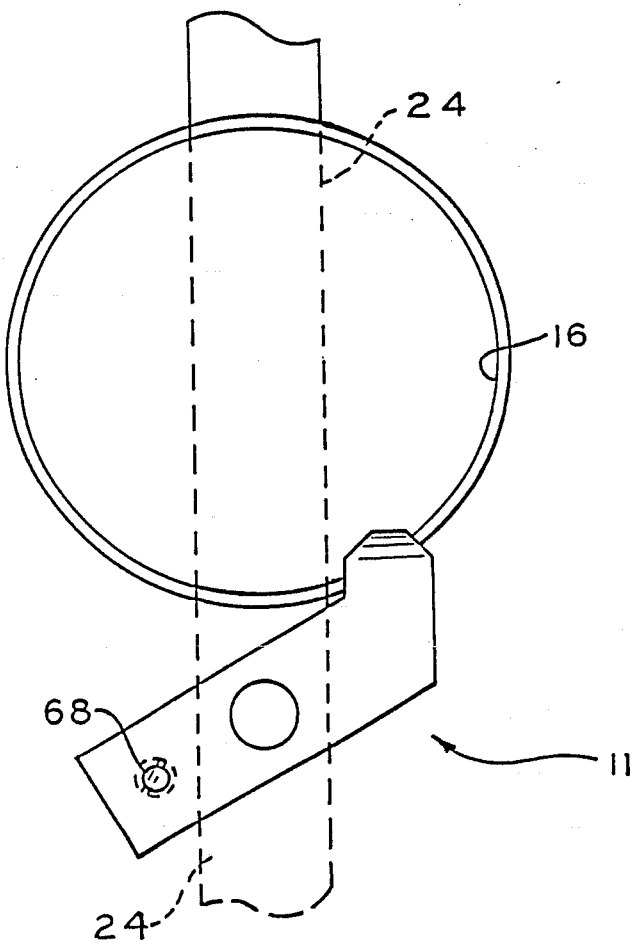
FIG. 6 is a fragmentary interior underside view of the engine and nozzle of FIG. 5 with the swing path of the piston connecting rod being illustrated in broken lines.

A modified embodiment of a piston cooling nozzle 11 is illustrated in FIGS. 5 and 6. Nozzle 11 is substantially identical in form and function to nozzle 10 except for the modifications described herein. The low profile construction allows for the outlet end of the nozzle 11 to be curved or bent away from the engine block when mounted so as to accommodate the end of the piston skirt, at the extreme piston travel position. In addition, the nozzle housing may have a pronounced bent-leg-type shape to provide sufficient clearance between the nozzle outlet and the piston connecting rod. The swing path of the piston connecting rod is denoted by numeral 24 in FIG. 6.

Figure 7:
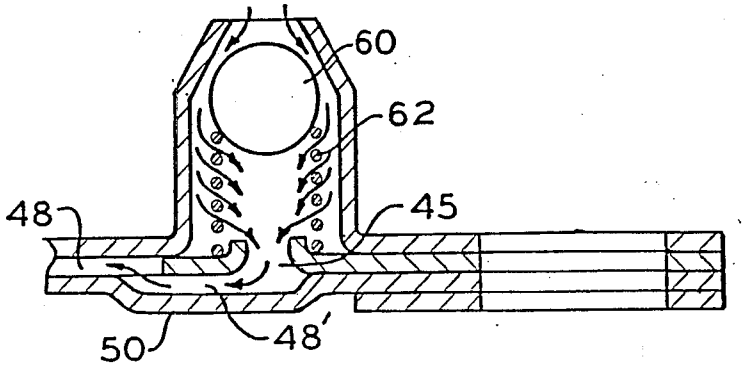
FIG. 7 is a fragmentary longitudinal sectional view of a third embodiment of a piston cooling nozzle in accordance with the present invention.

With reference to FIG. 7, the spring 62 may be configured to essentially function as an auxiliary filter. The spring 62 is configured to permit the passage of oil from the radial exterior to the central interior, as schematically illustrated by the flow path arrows. The spacings between the coils of the spring are dimensioned to prevent the passage of particulate manner. The walls defining the intermediate plate opening 45 are bent to form an upstanding shoulder for seating the end coil of the spring 62. A passageway 48' is defined by a contoured indented portion of the cover plate to form a fluid path from opening 45 through passageways 48' and 48 through the nozzle orifice 47.

Another filter system for the nozzle 10 is illustrated in FIGS. 2 and 3. Interior opposing surfaces of the housing base plate 30 and the cover plate 50 are configured with opposing arrays of stamped dimples 39 and 59, respectively, which cooperate to form an interior edge filter of the nozzle for filtering and preventing particulate matter from being deposited or lodged in the nozzle orifice 47. If particulate matter becomes lodged in the nozzle orifice, the spray characteristics of the nozzle could be dramatically altered. In some circumstances, the nozzle orifice could be entirely closed by particular matter. The spacing between the opposing faces of dimples 39 and 59 is dimensioned to provide the restricted passageway.

Figure 12:
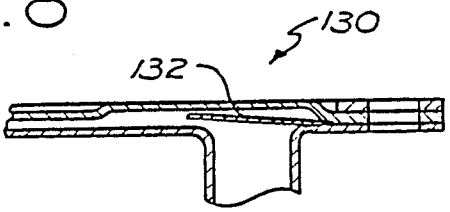
FIG. 12 is a fragmentary sectional view of a fifth embodiment of a piston cooling nozzle in accordance with the present invention.
Figure 11:
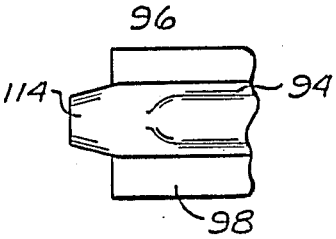
FIG. 11 is an enlarged fragmentary top view of an end portion of the piston cooling nozzle of FIG. 8.
Figure 9:
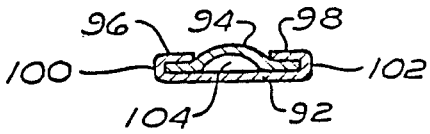
FIG. 9 is a sectional view of the piston cooling nozzle taken along the line 9—9 of FIG. 8.
Figure 10:
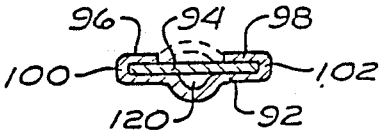
FIG. 10 is a sectional view of the piston cooling nozzle taken along the line 10—10 of FIG. 8.
Figure 13:
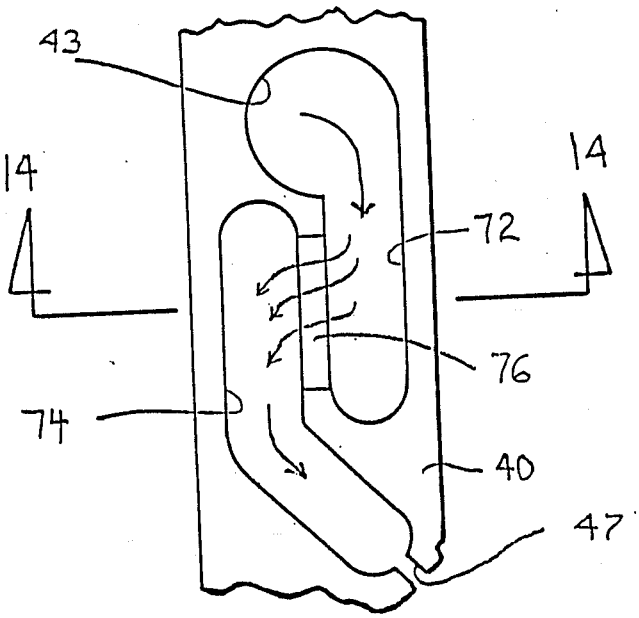
FIG. 13 is an enlarged fragmentary interior bottom view illustrating a filtering system employed in a piston cooling nozzle in accordance with the present invention.
Figure 14:
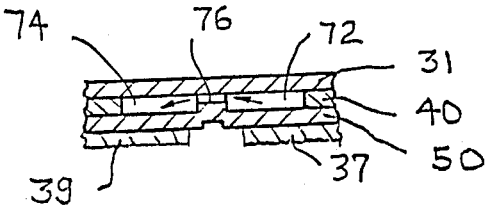
FIG. 14 is a fragmentary sectional view of the piston cooling nozzle taken along the line 14—14 of FIG. 13.

Another internal edge filtering system which may be incorporated into the nozzle 10 is illustrated in FIGS. 11 and 12. The passageway from the inlet opening to the nozzle orifice 47 has a pair of laterally offset, longitudinally extending passage segments 72 and 74. The passage segments 72 and 74 are separated by a ridge 76. The oil flow path to the nozzle orifice (denoted generally by the arrows) essentially crosses the ridge 76 through the gap between the ridge and the housing base plate 31. The clearance between the top surface of the ridge 76 and the underside of the base plate 31 is dimensioned to prevent particulate matter having a diameter greater than the clearance from traversing across the ridge. The ridge thus functions as an edge filter. It should be appreciated that the ridge may cooperate to form a gap between either the base plate or the cover plate.

With reference to FIGS. 8 through 11, another embodiment of a piston cooling nozzle in accordance with the present invention is generally designated by the numeral 90. Piston cooling nozzle 90 differs from the previously described oil spray nozzle 10 principally with respect to the body construction which is essentially stamped and shaped from two plates to form a housing base 92 and a cover 94. The base 92 includes integrally extending tabs 96 and 98 which extend from laterally spaced sidewalls 100 and 102, respectively. The tabs 96 and 98 are bent over and crimped against the cover plate 94 to form the nozzle body. The cover plate 94 cooperates with the generally planar support portion of the base 92 to form a nozzle passage 104.

Figure 8:
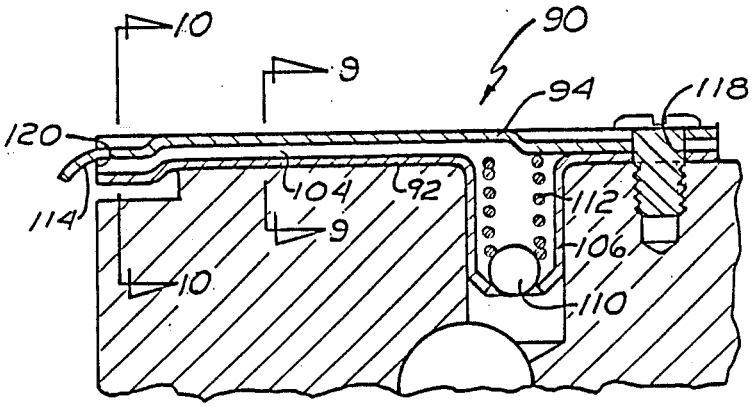
FIG. 8 is a longitudinal sectional view of a fourth embodiment of a piston cooling nozzle in accordance with the present invention, said nozzle being illustrated as mounted to a portion of the engine crankcase.

The housing base 92 is shaped to form a well 106 having an inlet opening 108. The well 106 receives a check valve assembly comprising a ball valve 110 and a spring 112 which biases the ball valve 110 against an interior well seat for closing the opening 108. The valve 110 and the spring 112 are captured between the cover plate 92 and the housing base 94 as best illustrated in FIG. 8.

The forward nose portion of the cover plate is bent or curved to form a deflector 114. It should be appreciated that the cover plate has a concave or arc-shaped section which partially defines the nozzle passage 104. The passage 104 leads from the inlet of the well to the formed nozzle orifice 120 defined between the cover plate 94 and the base plate 92 adjacent to the deflector 114. To better control the shape of the deflector 114, the contoured-shaped portions which define the nozzle passage 104 are formed in the housing base 94 at the nozzle end portion adjacent to the deflector 114 and nozzle orifice 120. An aperture 118 formed in the nozzle is adapted to receive a fastener for mounting the nozzle to the engine block 134 as previously described relative to nozzle 10.

With reference to FIG. 12, another embodiment of a piston cooling nozzle designated generally by the numeral 130 employs a leaf spring 132 in place of the previously described check valve assembly. The leaf spring 132 is positioned between opposing planar portions of the housing and the cover plate, and is secured in position by the folding over of the retaining tabs of the housing as previously described for nozzle 90. It should be appreciated that in some embodiments the retaining structures may integrally extend from the cover plate and be bent over the housing rather than the retaining structures extending from the housing sidewalls as described previously.

For some applications (not illustrated), neither a check valve assembly nor a leaf spring are required. A flow path is continuously defined between the nozzle inlet opening and the outlet orifice.

Figure 15:
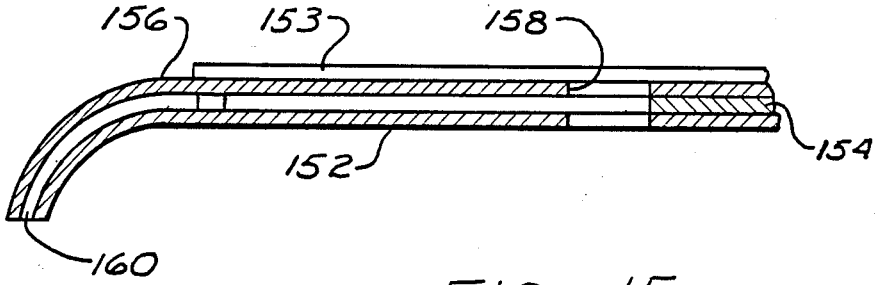
FIG. 15 is a sectional view of a sixth embodiment of a piston cooling nozzle in accordance with the present invention.
Figure 16:
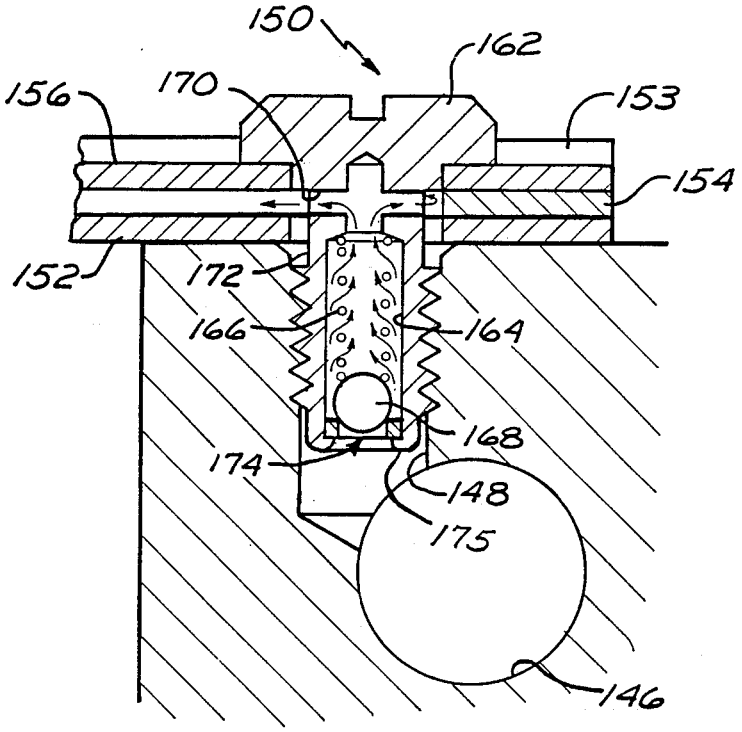
FIG. 16 is a fragmentary sectional view of the piston cooling nozzle of FIG. 15 said nozzle being illustrated as mounted to a portion of the engine crankcase.

With reference to FIGS. 15 and 16, another embodiment of a piston cooling nozzle is designated generally by the numeral 150. Oil spray nozzle 150 is suitable for applications where there is little existing room to accommodate the nozzle. Nozzle 150 includes a sheet metal nozzle base 152, an intermediate passage plate 154, and a cover 156. The base plate is folded around the passage plate and over the cover to form a retaining flange 153 as previously described. The assembled plates are bent or rounded to form a nozzle head, terminating in a nozzle orifice 160. An aperture 158 extends through the assembled plates.

With reference to FIG. 16, nozzle 150 is a highly compact nozzle for applications where there is insufficient clearance to incorporate a separately spaced check valve extension and a fastener for fastening the nozzle in position. The oil gallery 146 connects via a bore 148 for receiving a threaded fastener 162. The fastener 162 functions to both secure the nozzle in position and to house the nozzle check valve assembly. Fastener 162 includes a longitudinal bore 164 and a diametral bore 170 which opens through bore 164 near the top head portion of the fastener. The fastener and the adjacent portions of the nozzle aperture 158 cooperate to form an annulus 172 so that a passageway may be formed communicating from the oil gallery through bore 148, bore 164, bore 170 and annulus 172 for fluid communication through the nozzle passage and out the nozzle orifice 160. A threaded surface anchors the nozzle to the engine. A spring 166 biases a ball valve 168 which is secured by a press-fit retainer ring 174. The retainer ring 174 is secured into position to retain the spring/ball valve assembly within the bore 164 by crimping material 175 from the fastener 162 over the edge of the retaining ring 174. The retainer ring also functions as the valve seat for the ball valve 168. It will be appreciated that the foregoing nozzle 150 is highly compact due to the integration of the inlet check valve assembly with the mounting fastener for the nozzle.

The oil spray nozzles 10, 90, 130, and 150 as previously described, may be formed in a relatively efficient low-cost construction and assembly process to form a sandwich-type nozzle construction which has a compact low profile while also providing a suitable nozzle spray pattern for cooling the piston crown.

The housing components for the described nozzles may be assembled by a process wherein welding, brazing or similar methods are not required. The cooperative clamping engagement of the housing components is sufficient to maintain the components in assembled relationship and to seal the nozzle passageways. In one embodiment of the oil spray nozzle 10, the assembled housing 30 has a thickness which ranges from approximately 0.110 to 0.120 inches and a lateral width of approximately 0.60 inches with a length of approximately 1.5 inches. The diameter of the well opening 43 is approximately 0.28 inches, and the maximum width of the nozzle passage 48 is approximately 0.12 inches. The dimensions of opening 43 and passage 48 may be considerably different for a given engine application. In one embodiment of nozzle 90, the assembled housing has a thickness which ranges from approximately 0.085 to 0.108 inches.

In some situations, nozzle clearance with the cylinder or piston is not a significant problem, so that a longer nozzle flow path away from the gallery and greater precision in orientation of discharge, can be achieved.

Figure 17:
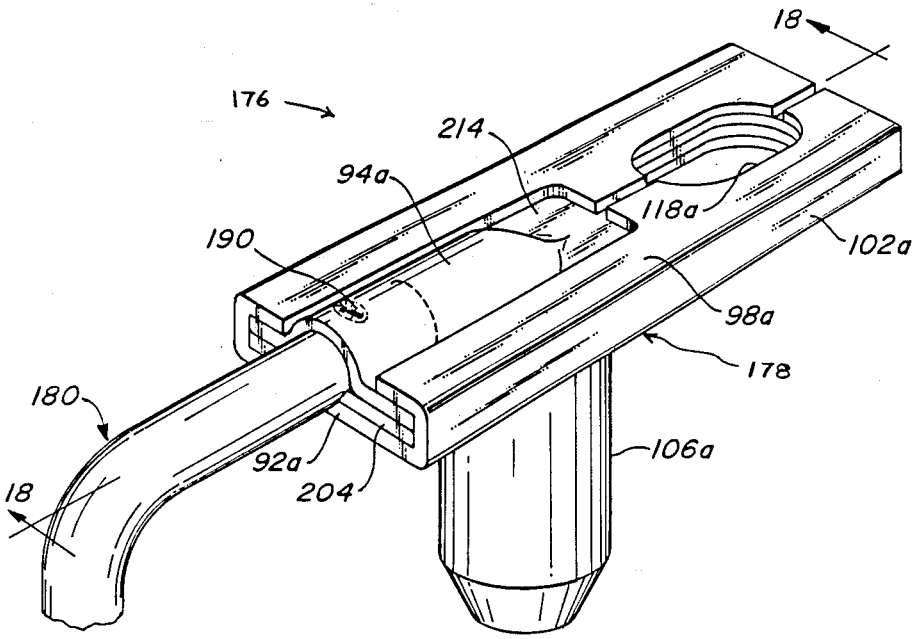
FIG. 17 is a perspective view of another embodiment of the invention, having a tubular nozzle tip.
Figure 19:
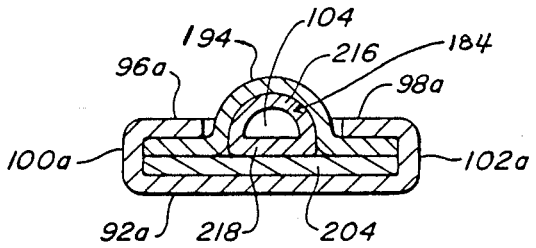
FIG. 19 is a cross sectional view of the nozzle assembly of FIG. 17 taken along line 19—19 of FIG. 18.
Figure 18:
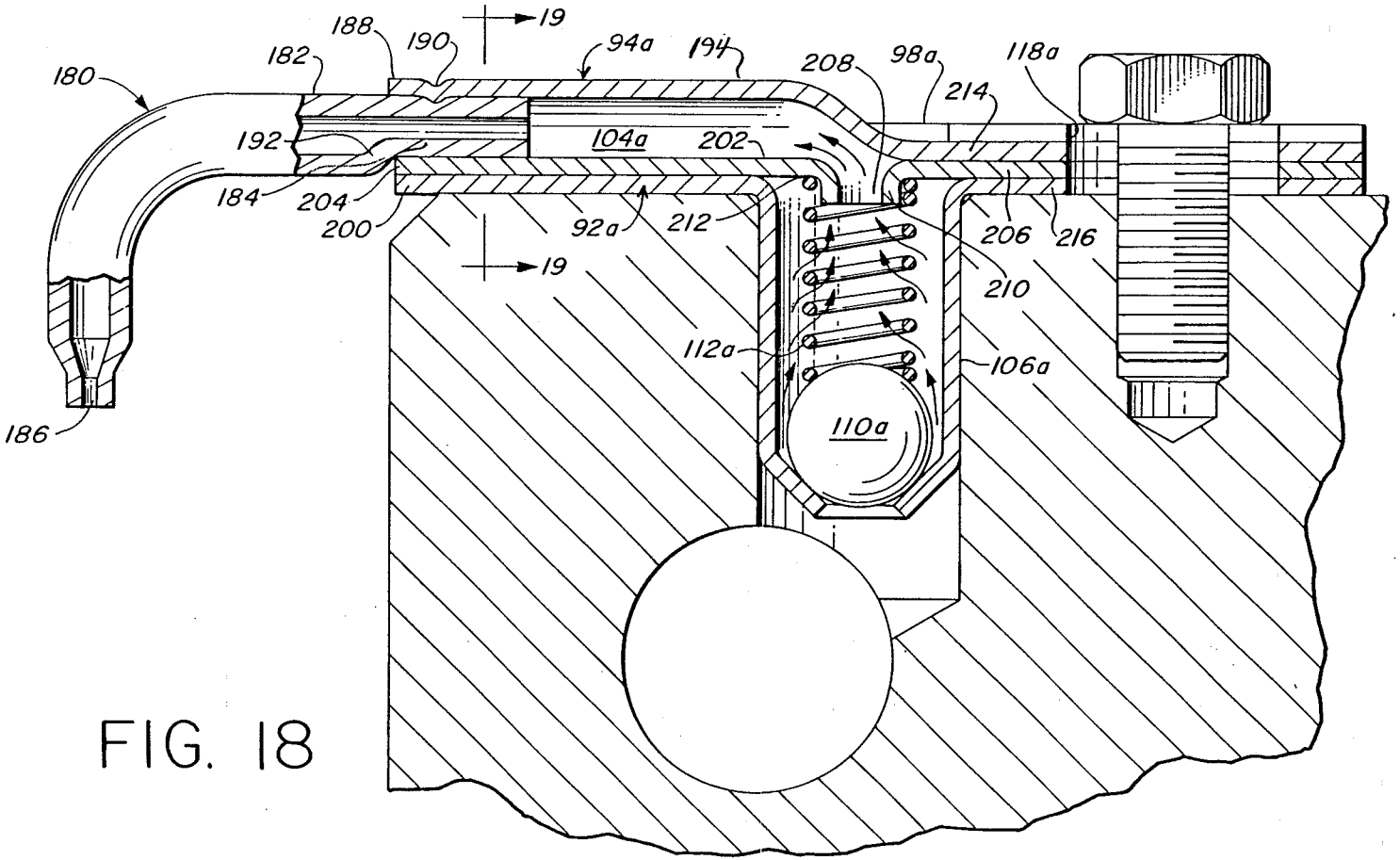
FIG. 18 is a cross sectional view of the nozzle assembly having a tubular tip, taken along line 18—18 of FIG. 17.

FIGS. 17–19 show an improvement relative to the nozzle assembly of the type shown in FIG. 8, whereby a longer, more sophisticated nozzle tip formed from a tubular member, extends from a nozzle holder portion fabricated from sheet metal. The connection between the nozzle tip and the nozzle holder is by means of an interference fit and thus, the entire nozzle assembly can be easily manufactured at relatively low cost, yet provide a high degree of customization with respect to the directionality and spray pattern of the cooling discharge.

The nozzle assembly 176 includes a holder portion 178 which contains components which are the same as, or functionally similar to, many of the components shown in FIG. 8. Reference thereto will be made by the same numeric identifiers as in FIG. 8, but followed by the suffix "a". The most significance difference between the nozzle assembly 176 of FIG. 17 and that of FIG. 8, is the provision of an elongated nozzle tip member 180, which is in effect, an extension of the nozzle passageway 104 and nozzle forming structure 114, 120 of FIG. 8.

The nozzle tip 180 typically has a cylindrical portion 182 with a desired bend angle of, for example, 90 degrees. The mounting end 184 is adapted to fit within the nozzle passageway **104*a* of the holder 178, and the other end 186** has an orifice adapted to discharge cooling fluid in a predetermined spray pattern.

The nozzle holder 178 includes a housing **92*a* which is substantially flat at longitudinal first and second ends 200, 216 and has an intermediate protrusion 106*a*, defining an inlet well through which cooling oil enters the holder 178. A cover plate 94*a* having a first end 188 and a second end 214 substantially coextensive with the housing first and second ends 200, 216, includes a longitudinally extending, arcuate, channel portion which, in cooperation with the forward portion of the housing 92*a*, forms the passageway 104*a***.

As shown in FIG. 19, the mounting end 184 of the nozzle tip 180 is preferably formed in a substantially D shape, which follows the contour of the passageway **104*a* defined by the cover plate 94*a* and the housing 92*a*. As with the previously described embodiments, when the integral flange portions 100*a*, 102*a* are bent over to form retaining rails 96*a*, 98*a* interacting with the lateral portions of the cover plate 94*a*, the nozzle holder 178 becomes self sealed and the nozzle tip 180 becomes mechanically sealed to the passageway 104*a*. Preferably the nozzle tip 180 is retained within the passageway 104*a* by means of an interference fit, such as a crimped joint 190, and locking ledge 192**.

In the preferred embodiment, the features associated with FIG. 7 are also incorporated into the nozzle holder 178. Thus, an intermediate plate 202 having a first end 204 and a second end 206 is sandwiched between the cover plate **94*a* and the housing 92*a*, at least at the respective second ends. Preferably, the first 204 and second 206 ends of the intermediate plate 202 are coextensive with the first 200, 188 and second 216, 214 ends of the housing and the cover plate, such that the portion of the intermediate plate 202 that extends longitudinally between the housing inlet well and the housing first end 200, defines the flat portion of the D shaped passageway 104*a*. The intermediate plate 202 has an orifice 208 located intermediate the passageway 104*a* and the inlet well 106*a*, this orifice preferably being formed by an annular rim 210. The rim provides a seating surface for valve coil spring 112*a* which acts to keep the ball 110*a* in sealing engagement with the inlet opening until a threshold oil pressure is reached. The inrushing oil must pass through the small gaps between the coils 112*a* before entering the orifice 208, thereby being filtered of particulates. The use of an intermediate plate 202 that is substantially coextensive with the housing 92*a* and the cover plate 94*a*, prevents leakage or bypass of the fluid around the spring 112*a*; thus all incoming fluid must pass through the filtering action of the spring. As shown in FIG. 19, in the preferred embodiment, the mounting end 184 of the nozzle tip 180 is sealed against the upper side of the first end 204 of the intermediate plate 202, rather than directly against the housing first end 200**.

It should be appreciated that effective sealing between a tubular nozzle tip 180 and a holder 178 made from flat sheet metal can be accomplished by proper crimping, or tightening of the flange tabs **96*a*, 98*a* against the lateral ends of the cover plate 94*a* and intermediate plate 202**, which are also substantially coextensive.

As with the previously described embodiments, a fastening aperture 118a can be formed in each of the housing member 92a, cover plate 94a, intermediate plate 202, and the tightening tabs 98a or flanges of the housing 92a.

As shown in FIG. 17, the assembled nozzle holder 178 resembles a box-type sandwich enclosure of the housing 92a around the cover plate 94a and intermediate plate 202.

The preferred method of fabricating the nozzle assembly 176 includes forming, from sheet metal, the housing member 92a and the cover plate member 94a, with one or the other having a greater transverse dimension for eventual folding over to encapsulate the other. The cover plate member 94a is also formed with a longitudinal, raised channel portion 194 extending from a location between the ends 188, 214 of the cover plate to the first end 188 of the cover plate. The intermediate plate 202 is substantially flat, except for the rim portion 210 defining the orifice 208. These parts are assembled such that the valve components 110a, 112a are aligned in the inlet well 106a, the intermediate plate 202 is positioned on the housing 92a, and the cover plate 94a is then positioned over the intermediate plate 202 and housing 92a to form passageway 104a. With the illustrated embodiment, the transversely extending tab portions 100a, 102a can be bent at 90 degrees to retain the intermediate plate and cover plate transversely.

The nozzle tip 180 is either originally drawn with the D shape mounting end 184 or squeezed to the desired shape. The mounting end 184 is inserted into the passageway 104a and secured by an interference fit 190. Alternatively, the mounting end 184 can be slightly upset and the cover plate crimped immediately ahead of the upset. The flanges 96a, 98a are then again bent and crimped into the configuration shown in FIGS. 17 and 19, whereby the flow path from the inlet well 106a through the orifice 208, passageway 104a and tip mounting end 184 is sealed.

It should be appreciated that in the engine crank case, perfect sealing of the nozzle assembly 176 is not necessary. Slight leakage contributes to the lubricating function of the oil in the crank case, and is tolerable so long as the bulk of the fluid entering the inlet well 106a is discharged through the nozzle orifice 186 for cooling the piston crown.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

We claim:

1. A method for fabricating a nozzle assembly of the type used for cooling the crown of a piston in an internal combustion engine, comprising:

forming from sheet metal, a housing member having first and second longitudinal ends and an inlet opening intermediate the ends;

forming from sheet metal, a cover plate member having first and second longitudinal ends adapted to substantially align with the first and second ends of the housing member, a longitudinal channel portion extending from a location between the ends of the cover plate to the first end of the cover plate, one of the cover plate or housing member having a transverse dimension greater than the transverse dimension of the other member;

positioning the cover plate member onto the housing member such that the housing member from the inlet opening to the housing first end and said channel, form a flow passageway from the inlet opening to the first end of the housing;

forming a substantially cylindrical tubular member into a bent nozzle tip member having a fluid discharge orifice and a mounting end;

shaping the mounting end into a cross section defined by the shape of the passageway at the first end of the housing member;

inserting the mounting end of the nozzle tip member into the passageway and securing the mounting end therein by an interference fit; and bending the sides of the housing member or cover plate member that has the greater transverse dimension, around the sides of the other member to sealingly encapsulate the mounting end of the nozzle tip member between the first ends of the housing member and cover member and to sealingly secure the housing member and cover plate member together.

2. The method of claim 1, wherein prior to the step of positioning the cover plate member on the housing member, a valve member is positioned between the channel and the inlet opening.

3. The method of claim 1, wherein the steps of forming the housing member and cover plate member include forming fastening apertures adjacent the second ends thereof.

4. The method of claim 1, wherein the cross section of the passageway is in the shape of a D.

5. The method of claim 4, wherein the step of forming the housing member inlet opening includes forming a protrusion in the sheet metal, and forming an opening in the extremity of the protrusion.

6. The method of claim 4, wherein prior to the step of positioning the cover plate member onto the housing member, taking the further steps of forming an intermediate plate member from sheet metal, the intermediate plate member having first and second longitudinal ends and an orifice intermediate the longitudinal ends; and positioning the intermediate plate member between the cover plate member and the housing member prior to the step of bending the sides.

7. The method of claim 6, wherein the second end of the intermediate plate member is sandwiched between the second ends of the housing member and the cover plate member, prior to bending the sides.

8. The method of claim 6, wherein the longitudinal dimension of the intermediate plate is substantially the same as that of the housing, and wherein the step of positioning the intermediate plate includes positioning a first end thereof onto the first end of the housing, prior to inserting the nozzle tip mounting end into said passageway.

9. The method of claim 4, wherein the step of forming the intermediate plate includes forming an orifice between the first and second ends thereof, and the step of positioning the intermediate plate includes aligning the orifice between the channel and the inlet opening.

10. A nozzle assembly for cooling the crown of a piston in an internal combustion engine, comprising:

housing means having a first end and an opposing second end and integrally forming a transversely protruding inlet well defining an inlet opening intermediate said first and second ends;

cover plate means having a first end and an opposing second end, the cover plate means being secured to set housing means so that said cover means cooperates with said housing means to define a passageway from said well to the first ends of the housing means and cover plate means;

an intermediate plate member located between and substantially coextensive with housing means and the cover plate means, and having first and second ends adjacent the first and second ends of the housing means and an orifice substantially coaxial with respect to the inlet well;

a nozzle tip member having one end mounted in said passageway and another end projecting from the housing means and adapted to discharge fluid in a predetermined spray pattern;

valve means comprising a valve member interposed between the inlet opening and said passageway and captured between said housing means and said intermediate plate means to interrupt the passage of fluid from said inlet opening to said nozzle tip member when said fluid has a pressure below a preestablished threshold;

wherein one of the housing means and cover plates means includes integral retaining flanges being bent around and against the other of said housing means and cover plate means to secure the housing means, cover plate means, intermediate plate member and nozzle tip member in assembled relationship.

11. The nozzle assembly of claim 10, wherein the mounted end of the nozzle tip member has a substantially D shaped cross section and wherein the first end of the cover plate means has a concave surface intimately bearing upon the convex portion of the nozzle mounted end.

12. The nozzle assembly of claim 10, wherein the intermediate plate orifice is defined by an annular rim projecting toward the inlet well, said rim forming a seat for said valve means.

13. The nozzle assembly of claim 12, wherein the valve means comprises spaced helical spring coils and said spring is seated by said rim in relation to the inlet opening so that said spring functions as a filter to the passage of fluid between said inlet opening and said nozzle passageway.

14. The nozzle assembly of claim 10, wherein said housing means and said cover plate means further define a transversely extending fastener aperture.

15. The nozzle assembly of claim 10, wherein said cover plate means has a longitudinal channel portion defining an arcuate surface and said intermediate plate has a planar portion which cooperates with the channel portion to define at least a portion of said passageway.

* * * * *